US005411812A

United States Patent [19]

Bilimoria

[11] Patent Number: 5,411,812

[45] Date of Patent: May 2, 1995

[54] GALVANIZED ULTRA-HIGH STRENGTH STEEL STRIP

[75] Inventor: Yaz F. Bilimoria, Munster, Ind.

[73] Assignee: Inland Steel Company, Chicago, Ill.

[21] Appl. No.: 136,543

[22] Filed: Oct. 14, 1993

Related U.S. Application Data

[62] Division of Ser. No. 874,029, Apr. 27, 1992.

[51] Int. Cl.[6] ..... B32B 15/18

[52] U.S. Cl. ..... 428/595; 428/603; 428/659

[58] Field of Search ..... 428/595, 603, 658, 659; 148/328

[56] References Cited

U.S. PATENT DOCUMENTS 3,378,369 4/1968 McFarland ..... 29/196.4
4,361,448 11/1982 Sippola ..... 148/15
4,408,561 10/1983 Yokoyama et al. ..... 118/72
5,156,690 10/1992 Asano et al. ..... 428/659
5,180,449 11/1993 Masui et al. ..... 428/659

OTHER PUBLICATIONS

Japanese Provisional Publication No. H 1-198459 (1989) (Kokai).

*Primary Examiner*—George Wyszomierski
*Attorney, Agent, or Firm*—Marshall, O'Toole, Gerstein, Murray & Borun

[57] ABSTRACT

Ultra-high strength galvanized steel strip is produced from martensitic, plain carbon, steel strip which is pretreated by induction heating rapidly or by fluxing, then hot dip galvanized and tempered, and then cooled to stop further tempering. The resulting galvanized steel strip has a microstructure comprising tempered martensite, a tensile strength substantially greater than 120,000 psi (827 MPa) and a coating weight substantially greater than 30 g/m$^2$/side.

17 Claims, 1 Drawing Sheet

GALVANIZED ULTRA-HIGH STRENGTH STEEL STRIP

This is a division of U.S. application Ser. No. 07/874,029, filed Apr. 27, 1992.

BACKGROUND OF THE INVENTION

The present invention relates generally to galvanized steel strip, and more particularly to ultrahigh strength galvanized steel strip and to a method for producing such a strip.

Normally, the term "ultra-high strength" refers to steel having a tensile strength greater than 100,000 psi (689 MPa). However, as used herein, the term "ultra-high strength" refers to steel having a tensile strength substantially greater than 120,000 psi (827 MPa).

There are many fabricated steel products, which, in use, require ultra-high strength. Many of these same fabricated steel products are exposed to corrosive conditions and therefore require a relatively high resistance to corrosion. Examples of fabricated steel products which require a combination of corrosion resistance and ultra-high strength include automobile bumper reinforcement beams and automobile door intrusion beams. Such fabricated steel products are usually formed from steel strip.

High strength can be imparted to a steel strip by incorporating certain alloying elements into the strip, but that increases the cost of the steel. Ultra-high strength plain carbon steel, without costly strength-imparting alloying additions, is available in strip form; it is known as martensitic, plain carbon steel strip, and it is disclosed in McFarland U.S. Pat. No. 3,378,360, which describes both the composition of the steel and the method for producing the steel strip so as to impart ultra-high strength thereto. The disclosure of the aforementioned McFarland patent is incorporated herein by reference. Ultra-high strength plain carbon steel, without alloying additions, is less expensive than ultra-high strength steel containing alloying additions for imparting ultra-high strength thereto.

Corrosion resistance can be imparted to steel strip by galvanizing, i.e. coating the steel strip with zinc or a zinc alloy. One conventional process for galvanizing steel strip is the hot dip process in which the steel strip is dipped in a bath of molten coating metal. The hot dip process is continuous and requires, as a preliminary processing step, pre-treating the steel strip before the strip is coated with zinc or zinc alloy. This improves the adherence of the coating to the steel strip. The pre-treating step can be either a preliminary heating operation or a conditioning operation in which the strip surface is conditioned with an inorganic flux. When a fluxing operation is employed, the preliminary heating operation is eliminated. When martensitic, plain carbon steel strip is subjected to heating, either in a conventional preliminary heating operation, or in the course of coating the strip with zinc or zinc alloy in a molten coating bath, or both, the steel strip loses much of its ultra-high strength.

There is another procedure for galvanizing steel, known as electro-galvanizing, which deposits a zinc coating on the steel strip, or on the fabricated part, by electroplating, rather than by hot dipping. When the steel undergoes electro-galvanizing, it is neither subjected to a preliminary heating or fluxing operation nor dipped into molten zinc or zinc alloy; therefore the steel strip loses substantially none of its strength during the coating operation. It is not commercially practical to electro-galvanize martensitic, plain carbon steel strip in a continuous operation because of a slight, inherent waviness in martensitic, plain carbon steel strip which precludes one from running that strip through a conventional high speed electro-galvanizing line. Instead, electro-galvanizing would have to be performed on the product fabricated from the martensitic plain carbon steel strip. However, electro-galvanizing is a relatively expensive operation, and at zinc coating weights above about 30 g/m$^2$/side, electro-galvanizing of steel products of the type under consideration here is not commercially practical.

A coating weight of 30 g/m$^2$/side or less is not sufficiently heavy to impart the desired corrosion resistance to products of the type under consideration here, which usually require a zinc coating weight substantially greater than 30 g/m$^2$/side, and preferably greater than 60 g/m$^2$/side. Moreover, products of the type under consideration here are subjected to deforming operations, during their fabrication, which result in at least one inside corner being formed on the product, and inside corners are difficult to coat without coating deficiencies when the coating is applied by electro-galvanizing. Thus, electro-galvanizing of such a product has at least two drawbacks: a relatively light coating weight throughout and a deficient coating at inside corners. The net result is that products subjected to electro-galvanizing have less corrosion resistance than if the same product were subjected to galvanizing by hot dip coating.

One cannot eliminate the preliminary pre-treating step during the conventional continuous hot dip galvanizing process, because this step is necessary in order to assure an adherent, galvanized coating on the steel strip.

SUMMARY OF THE INVENTION

In accordance with the present invention, there is produced an ultra-high strength, galvanized steel strip comprising (a) a plain carbon steel substrate having a microstructure consisting essentially of tempered martensite and (b) an adherent coating consisting essentially of zinc or zinc alloy. Tempered martensite comprises a martensitic matrix with iron carbide particles dispersed throughout. The steel strip has a tensile strength substantially greater than 120,000 psi (827 MPa). The galvanized coating has a coating weight substantially greater than 30 g/m$^2$/side and preferably at least about 60 g/m$^2$/side, and the coating is applied by a continuous hot dip process, including a preliminary pre-treating step.

The steel strip described in the preceding paragraph is produced by a continuous, hot dip, galvanizing process wherein the starting material is a plain carbon steel strip having an initial microstructure consisting essentially of untempered martensite. The strip is initially cleaned, e.g. in a warm, acidic bath, and then, in one embodiment, rapidly heated in an induction heating zone having a reducing atmosphere, to an elevated strip temperature above 600° F. (316° C.) and at which the untempered martensite undergoes transformation to tempered martensite. Alternatively, the steel strip can be pre-treated with an inorganic flux. The pre-treated steel strip is then passed through a bath of molten coating metal consisting essentially of zinc or zinc alloy, to coat the steel strip with the coating metal.

During the coating step described in the preceding sentence, tempering of martensite occurs. As noted above, tempering can also result from the induction heating step to which the strip has been subjected before the coating step. In both embodiments, tempering occurs because the steel strip is heated, either by induction heating or by the temperature of the molten coating bath or by both, to an elevated strip temperature above 600° F. (316° C.) and at which the untempered martensite undergoes transformation to tempered martensite. After the coating step, the coated steel strip is then cooled to a depressed temperature below 600° F. (316° C.) and at which transformation to tempered martensite will not occur.

When employing the induction heating step to pre-treat the strip, the process includes the steps of (a) controlling the temperature in the induction heating zone and in the molten coating bath and (b) controlling the time at which the steel strip is at the elevated strip temperature at which transformation to tempered martensite occurs. These controls are exercised in a manner which assures the presence in the steel substrate, after the cooling step, of a microstructure consisting essentially of tempered martensite.

When one employs fluxing to pre-treat the strip, one controls the temperature to which the steel strip is heated, and the time during which the steel strip is at the elevated strip temperature at which tempering occurs, by controlling the temperature of the molten coating bath and the time during which the steel strip is immersed in that bath.

When a strip of steel having a microstructure of untempered martensite is heated so that the untempered martensite transforms to tempered martensite, the steel strip undergoes a loss in tensile strength. The tensile strength of a tempered, martensitic steel strip, after completion of the coating process of the present invention, depends in part upon the tensile strength of the untempered, martensitic steel strip which was used as the starting material. For a given set of processing conditions, the higher the tensile strength of the untempered, martensitic steel strip used as the starting material, the higher will be the tensile strength of the tempered, martensitic steel strip which has undergone galvanizing.

Generally, in a process in accordance with the present invention, the steel strip will undergo a loss in tensile strength of about 35,000 to 45,000 psi (239–310 MPa) due to tempering of the martensite. Martensitic, plain carbon steels are commercially available with a nominal tensile strength of up to about 220,000 psi (1517 MPa), so that ultra-high strength, galvanized steel strip can be provided, in accordance with the present invention, with a tensile strength up to about 180,000 psi (1241 MPa) or higher, for example.

A galvanized, steel strip produced in accordance with the present invention can have both (1) ultra-high strength and (2) a coating weight substantially greater than 30 $g/m^2$/side, e.g. 60–130 $g/m^2$/side.

Other features and advantages are inherent in the product and method claimed and disclosed or will become apparent to those skilled in the art from the following detailed description in conjunction with the accompanying diagrammatic drawing.

DETAILED DESCRIPTION

Figures 1, 2, 3, 4:
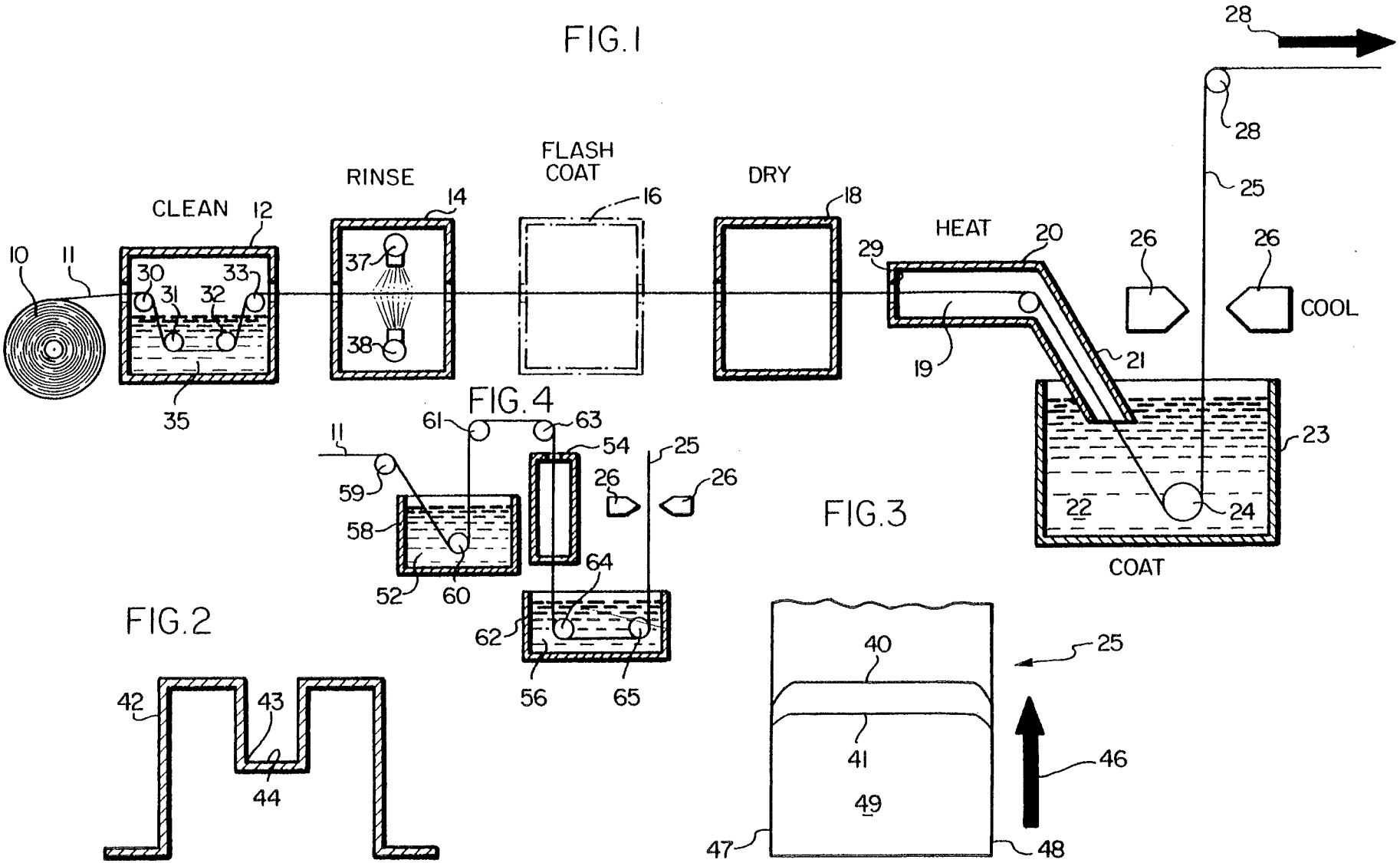
FIG. 1 is a flow diagram illustrating a continuous, hot dip galvanizing process in accordance with one embodiment of the present invention.
FIG. 2 is a sectional view of a fabricated steel product produced from a steel strip in accordance with an embodiment of the present invention.
FIG. 3 is an enlarged edge view of a steel strip in accordance with an embodiment of the present invention, illustrating the microhardness profile of the strip, across its thickness.
FIG. 4 is a fragmentary flow diagram illustrating a portion of another embodiment of a process in accordance with the present invention.

Referring initially to FIG. 1, a strip 11 of plain carbon, untempered martensitic steel is unwound from a coil 10 and subjected to a cleaning step at 12, followed by a rinsing step at 14 and a drying step at 18. Optionally, strip 11 can be subjected to a flash coating step at 16 during which a flash coat of nickel or copper is applied to the strip. After drying at 18, the steel strip is rapidly heated at an induction heating zone 20 having a snout 21 extending angularly downwardly into a bath 22 of molten coating metal contained within a container 23 including a roller 24 around which the strip passes as it moves through coating bath 22. The coating bath has a conventional composition, e.g. all zinc or zinc with 0.12–0.2 wt. % aluminum.

A galvanized strip 25 emerges from bath 22 and is cooled by cooling jets or air knives 26, a conventional device normally employed to control the coating weight (thickness) of the galvanized coating. The cooled, galvanized steel strip then passes around a roller 27 and proceeds downstream in the direction 28 to a coiling station (not shown) for rewinding into a coil. Prior to rewinding into a coil, the strip passes through a cooling station (not shown), downstream of roller 28, where the strip is subjected to further cooling by ambient temperature air to cool the strip to a temperature appropriate for coiling (e.g. 200° F. (93° C.) or less).

The various processing steps embodied in a method in accordance with the present invention will now be described in greater detail. As previously noted, the starting material for coil 10 and strip 11 is a plain carbon, untempered, martensitic steel without alloying ingredients added for strengthening purposes, other than carbon and manganese. More particularly, the plain carbon steel has a composition consisting essentially of, in weight percent:

| | |
|---|---|
| Carbon | .03–.25 |
| Manganese | .20–1.50 |
| Phosphorus | .05 max |
| Sulfur | .03 max |
| Iron | essentially the balance. |

Preferably, the carbon content is at least about 0.09 wt. % and the manganese is at least about 0.34 wt. %. Additional details with respect to the plain carbon, untempered, martensitic steel, and to a process for producing that steel are contained in the aforementioned MacFarland U.S. Pat. No. 3,378,360, the disclosure of which has been incorporated herein by reference.

Examples of plain carbon, untempered, martensitic steel are set forth below in Table I, with the amount of the individual elements therein given in weight percent. In all examples, the balance consists essentially of iron.

TABLE I

| Example | C | Mn | P | S |
|---|---|---|---|---|
| A | 0.07 | 0.45 | 0.010 | 0.015 |
| B | 0.10 | 0.45 | 0.010 | 0.015 |
| C | 0.18 | 0.45 | 0.010 | 0.015 |
| D | 0.23 | 0.45 | 0.010 | 0.015 |
| E | 0.15 | 1.40 | 0.010 | 0.015 |

Typical mechanical properties for these examples are set forth below in Table II.

TABLE II

| Example | Tensile Strength psi (MPa) | Yield Strength psi (MPa) | Elongation % in 2 in. (50.8 mm) |
|---|---|---|---|
| A | 153,000 (1070) | 134,000 (935) | 5.7 |
| B | 171,000 (1195) | 148,000 (1030) | 5.0 |
| C | 206,000 (1440) | 176,000 (1230) | 4.9 |
| D | 236,000 (1650) | 202,000 (1410) | 4.7 |
| E | 198,000 (1365) | 173,000 (1192) | 5.0 |

As noted above, the mechanical properties, including tensile strength, vary with carbon content, and they also vary with manganese content. The particular composition to be selected for the starting material will depend upon the tensile strength desired in the coated steel strip which in turn depends upon the tensile strength desired in the steel product fabricated from that strip product. The higher the initial tensile strength of the untempered, martensitic plain carbon steel strip, the higher will be the tensile strength of the coated steel strip, for a given set of processing conditions.

After the starting material comprising strip 11 is unwound from coil 10, the strip is directed by guide rollers 30–33 through a cleaning bath 35 typically composed of 12–14 wt. % dilute hydrochloric acid maintained at a temperature in the range of about 110°–130° F. (43°–54° C.), for example. The cleaning step assists in removing undesired, extraneous materials from the surface of strip 11 to provide a clean, exposed metallic surface on strip 11. The cleaning step performed at 12 may be somewhat more vigorous than the cleaning step normally employed in conventional hot dip galvanizing processes.

Prior to cleaning at 12 with acid batch 35, strip 11 may be rinsed in a bath of alkaline rinse solution conventionally employed in many commercial galvanizing operations.

After cleaning at 12 with acid bath 35, the strip is rinsed at 14 by sprays from upper and lower spray nozzles 37, 38 which direct, onto the respective upper and lower surfaces of strip 11, hot water having a temperature in the range of about 110°–115° F. (43°–46° C.), for example.

The drying step, to which the strip is subjected at 18, typically employs hot air having a temperature of about 200° F. (93° C.).

The optional flash coating step, to which the strip may be subjected at 16, employs a conventional electroplating step commonly utilized for applying a flash coat of nickel or copper, for example. Typically, the flash coat would have a coating weight in the range of about 200–400 mg/m$^2$/side.

Both the cleaning and the flash coating steps are employed to improve the adherence of the galvanized coating to the steel substrate. In those cases where adherence is satisfactory without the employment of the flash coating step, that step may be eliminated.

As previously noted, strip 11 is rapidly heated by induction heating before it enters molten coating bath 22. Induction heating is performed by conventional induction heating coils (not shown) which may be located in snout 21 of zone 20 or upstream of snout 21 at 19. The entirety of induction heating zone 20, comprising 19 and 21, is provided with a reducing atmosphere which extends continuously from the upstream end 29 of induction heating zone 20 to the location where snout 21 enters bath 22. The reducing atmosphere is composed of hydrogen and nitrogen gases, with each of these gases being present somewhere in the range 15–85 wt. %. The reducing atmosphere is a conventional atmosphere normally utilized in the preliminary heating step normally preceding the hot dip coating step in a conventional hot dip galvanizing process.

The temperature to which strip 11 is heated, during the induction heating step, and the temperature at which molten coating bath 22 is maintained, depend upon the tensile strength desired in the steel product fabricated from that strip. The untempered martensite constituting the starting material of strip 11 undergoes tempering during the heating and hot dip coating steps. The higher the elevated temperature to which strip 11 is heated during those two steps, and, to a lesser extent, the longer the time at which the strip is maintained at the elevated temperature, the more tempering the strip will undergo. For an untempered, martensitic steel strip having a given tensile strength, the more tempering the strip undergoes, the lower will be the tensile strength of the steel product fabricated from that strip.

Generally, strip 11 is heated to an elevated strip temperature above 600° F. (316° C.) and typically above 725° F. (385° C.) during the induction heating step, and the elevated strip temperature generally is never allowed to exceed 900° F. (482° C.). To assure that strip 11 is maintained at an elevated strip temperature which gives the desired tensile strength in the steel product fabricated from strip 11, the induction heating step should be controlled so that the strip temperature due to induction heating preferably does not exceed the desired elevated strip temperature; and one should also control the temperature of molten coating bath 22 so that the desired elevated strip temperature is not exceeded.

For example, assuming that the desired elevated strip temperature is 825° F. (440° C.), one should then control the induction heating step so that the strip temperature due to induction heating is no greater than 825° F.; and one should also control the temperature of the molten coating bath so that the strip temperature leaving the molten coating bath also is substantially no greater than 825° F. Of course, for the same example, if one obtains a strip temperature, due to induction heating, below 825° F. (440° C.), one may then employ a higher molten coating bath temperature. The various combinations of these two temperatures can be determined empirically. Generally speaking, one typical temperature to which the strip is pre-heated may be around 800° F. (427° C.), and a typical molten coating bath temperature may be in the range of about 800°–850° F. (427°–454° C.), for example.

Tempering of martensite generally occurs at a temperature above 600° F. (316° C.). The time period during which the strip is at a tempering temperature is limited to a time generally no greater than about 25 seconds (e.g. 15–25 seconds). The tempering time period begins when the strip first attains this temperature, usually due to induction heating. Air knives 26 cool coated strip 25 to a temperature below that at which tempering occurs, so that the tempering time period ends when the strip is cooled by air knives 26. The cooling fluid is typically air. The length of the tempering time period is controlled by the speed with which strip 11 moves through the processing steps at heating zone 11 and bath 22, up to air knives 26.

In summary, the uncoated steel strip is heated to an elevated strip temperature at which an adherent coating will form on the steel strip when the strip undergoes coating. The elevated strip temperature is no greater than about 900° F. (482° C.) and no lower than 600° F. (316° C.), preferably no lower than 725° F. (385° C.). The steel strip is maintained at the elevated strip temperature, in the range described in the preceding sentence, for a time in the range 15–25 seconds, for example, preferably no more than about 20 seconds.

Generally speaking, when following the processing parameters of the present invention, as described above, there is a loss in tensile strength, between the starting material and the resulting coated steel strip, of about 40,000 psi (276 MPa). Thus, assuming the starting material is an uncoated steel strip having an initial tensile strength at room temperature of at least about 190,000 psi (1310 MPa), after processing in accordance with the present invention, the substrate of the coated steel strip has a tensile strength upon being cooled to room temperature of at least about 150,000 psi (1034 MPa); and if the starting material is an uncoated steel strip having an initial tensile strength of at least about 200,000 psi (1379 MPa), after processing in accordance with the present invention, the substrate of the coated steel strip has a tensile strength at room temperature of at least about 160,000 psi (1103 MPa).

Depending upon the tensile strength of the starting material, and upon the elevated temperature to which the strip is heated during induction heating and hot dip coating as well as upon the time during which the strip is at that elevated temperature, the tensile strength of the substrate of the coated steel strip, at room temperature, may be anywhere in the range of about 120,000–190,000 psi (827–1310 MPa). Preferably, upon being cooled to room temperature, the coated strip comprises a substrate having a tensile strength of at least 150,000 psi (1034 MPa). Most preferably the tensile strength is at least 160,000 psi (1103 MPa), and the ratio of yield strength to tensile strength, in the substrate, is at least 0.95.

The resulting galvanized steel strip 25 comprises (a) a plain carbon steel substrate having the composition described above and (b) an adherent, hot dip metal coating consisting essentially of zinc or zinc alloy covering the substrate. The product is characterized by a substrate microstructure consisting essentially of tempered martensite comprising a martensitic matrix with iron carbide particles dispersed throughout. The particles of iron carbide dispersed in the martensitic matrix are typically relatively fine compared to the platelet size of the martensite, e.g. an average iron carbide particle size in the range 2 to 3 microns ($2\text{–}3\times10^{-6}$m), and the average spacing between iron carbide particles is generally in the range 10 to 20 microns ($10\text{–}20\times10^{-6}$m), for example. In a cross-sectional view of the microstructure, the iron carbide particles typically cover about 10 to 20% of the total visible area.

The strip's coating has a coating weight substantially greater than 30 g/m$^2$/side. Preferably the coating weight is in the range of about 60–130 g/m$^2$/side and most preferably 90–130 g/m$^2$/side. There is essentially no detectable layer of iron-zinc alloy between the substrate and the coating, and this characteristic reflects the controls exercised with respect to the maximum elevated temperature to which the strip is heated and the time the strip spends at that elevated temperature.

The strip is elongate, and when coiled, is in the form of a coil having a multitude of coil laps and a pair of strip ends. The substrate has substantially uniform mechanical properties between the strip ends. Examples of these mechanical properties are summarized in Table III set forth below. The peak strip temperatures, the molten bath temperature and the time included in the tabulation are typical processing parameters one may employ for obtaining the mechanical properties listed in the tabulation.

TABLE III

| Strip Micro-Structure | Peak Strip Temp. | Tensile Strength, psi (MPa) | Yield Strength, psi (MPa) | Ratio Y.S. to T.S. | Total Elongation % |
|---|---|---|---|---|---|
| Untempered Martensite | — | 208,000 (1434 MPa) | 176,000 (1213 MPa) | .85 | 3.0 |
| Tempered Martensite | 870° F. (466° C.) | 149,200 (1029 MPa) | 145,700 (1004 MPa) | .98 | 5.9 |
| Tempered Martensite | 800° F. (427° C.) | 155,000 (1069 MPa) | 153,500 (1058 MPa) | .99 | 5.6 |
| Tempered Martensite | 750° F. (399° C.) | 165,500 (1141 MPa) | 164,400 (1133 MPa) | .99 | 4.8 |

Molten Bath Temp. = 800–810° F. (427–432° C.); total time above 600° F. (316° C.) = ~12–15 sec.

As previously noted, there is substantial uniformity in the strip's mechanical properties between the head and tail of the coil, or between any shorter strip cut from the coil. For a tempered martensitic strip produced in accordance with the present invention and having a nominal tensile strength of 165,000 psi (1138 MPa), the variation in tensile strength from one end to the other is only about ±1,000 psi. In contrast, for a steel strip composed of untempered martensite and having a nominal tensile strength of 160,000 psi (1103 MPa), the variation in tensile strength is about ±3,000 psi.

Tempered martensite is tougher, i.e. less brittle, than untempered martensite. For example, assuming a steel composed of untempered martensite and having a total elongation no greater than about 5%, when that steel is subjected to a process in accordance with the present invention, the resulting tempered martensite has a total elongation in the range 7–7.5%, for example.

A coated steel strip having a tempered martensitic substrate has a much narrower spread between tensile strength and yield strength than does an uncoated, untempered martensitic steel. For example, assuming a steel having a nominal tensile strength of 160,000 psi (1103 MPa), an uncoated, untempered martensitic steel has a ratio of yield strength to tensile strength less than 0.9 whereas a coated, tempered, martensitic steel produced in accordance with the present invention and having a 160,000 psi tensile strength, has a ratio of yield strength to tensile strength greater than 0.95.

The substrate typically has a thickness in the range of about 0.02–0.07 inches (0.51–1.78 mm), and there is a relatively uniform microhardness, expressed in Vickers hardness numbers or Knoop hardness numbers, across the thickness of the substrate. This is reflected by FIG. 3 which shows a fragment of the substrate of strip 25, as viewed from the edge thereof.

In FIG. 3, strip 25 has opposed substrate surfaces 47, 48 and an edge 49 therebetween. Line 40 is representational of the microhardness profile for the uncoated, martensitic steel strip, before the strip undergoes processing in accordance with the present invention. Line 41 is representational of the microhardness profile across the edge of the strip after the coated, tempered martensitic strip has been subjected to processing in accordance with the present invention. Microhardness increases in the direction of arrow 46 in FIG. 3.

As can be seen from comparing profile lines 40 and 41, although the microhardness of the tempered, martensitic strip (profile line 41) is lower than the microhardness of the untempered strip (profile line 40), the variation between those portions of the strip adjacent a surface 47, 48 thereof and those portions deeper within the interior of the strip is much less for the tempered martensitic strip (profile line 41) than it is for the untempered martensitic strip (profile line 40). Profile lines 40, 41 have been smoothed out to eliminate irregularities in the profile lines, but the profile lines would be the same, in a general sense, even if the irregularities were to be included.

After strip 25 has been wound into a coil, it is shipped to a customer who unwinds the strip from the coil and fabricates parts from the strip. A typical example of such a part is an automobile bumper reinforcement beam whose cross-section is indicated at 42 in FIG. 2. Other examples of products formed from strip 25 include automobile door intrusion beams and automobile gas tank safety shields. Bumper beam 42 typically has at least one inside corner 43 and a planar area 44, for example. When beam 42 is made from a strip 25 produced in accordance with the present invention, there is no substantial difference between the coating weight at inside corner 43 and the coating weight at planar area 44, both coating weights being at least 60 $g/m^2$/side, for example. This is in contrast to a bumper beam having the same configuration and which is coated, after forming, by an electro-galvanizing operation. Typically, the aim coating weight provided by such an operation would be about 30 $g/m^2$/side, and the coating weight at inner corner 43 would be less than the coating weight on planar area 44.

The foregoing discussion relates to that embodiment of the present invention in which the pre-treating step is an induction heating operation. As previously noted, there is another embodiment of the present invention in which the pre-treating step employs a fluxing operation, and in which induction heating is not employed. Details of the fluxing operation are described below.

The properties and characteristics of the galvanized steel strip produced by the embodiment employing a fluxing operation are essentially the same as for the galvanized steel strip produced by the embodiment employing an induction heating operation.

The embodiment employing the fluxing operation dispenses with the induction heating operation and substitutes fluxing and drying steps; otherwise the processing steps in the two embodiments are generally the same except that drying at 18 and the optional flash coating at 16 are not employed when using the fluxing operation.

Referring now to FIG. 4, after strip 11 has been rinsed at 14, the strip is passed over a roller 59 and through a fluxing bath 52 containing an inorganic flux, then dried at 54, and then passed through a molten coating bath 56 containing molten zinc or zinc alloy, after which the strip is cooled by air knives 26.

Fluxing bath 52 is contained in a vessel 58 having a roller 60 around which strip 11 passes as the strip moves through the fluxing bath. The flux is typically a solution of the double salt of zinc chloride and ammonium chloride in water. Concentration of the aqueous solution is typically 700–800 grams of salt per liter of water, and the double salt is composed of 56 wt. % zinc chloride and 44 wt. % ammonium chloride, for example.

Between fluxing bath 52 and drier 54, strip 11 passes around a pair of direction-changing rollers 61, 63.

The drying step at 54 employs, as the drying medium, hot air having a temperature in the range of about 200°–400° F. (93°–204° C.), e.g. 300° F. (149° C.), and the strip is subjected to the drying medium for a time in the range of about 8–15 seconds, e.g. 10 seconds.

Molten coating bath 56 is contained in a vessel 62 having a pair of rollers 64, 65 around which the strip passes as the strip moves through bath 56. Optionally, one roller may be employed in vessel 62.

Molten coating bath 56 is typically at a temperature in the range 800°–900° F. (427°–482° C.), and the time during which strip 11 is immersed in bath 56 is typically in the range 15–20 seconds. During the time the strip is in bath 56, the strip is heated to a tempering temperature above 600° F. (316° C.) and at which untempered martensite undergoes transformation to tempered martensite. For a bath 56 having a temperature in the range 800°–900° F. (427°–482° C.), the strip will attain a temperature in that range while the strip is immersed in bath 56, and the strip will be at that strip temperature, in the bath, for a time period of at least 10 seconds, e.g. 10–15 seconds for a strip immersion time of 15–20 seconds.

Upon emerging from bath 56, the coated strip 25 is cooled by air knives 26 to a temperature below 600° F. (316° C.) to end the transformation from untempered to tempered martensite. The extent of that transformation depends upon the temperature to which the strip was heated in bath 56, and the length of time the strip was at that temperature. The strip temperature can be controlled by controlling the temperature of bath 56; the time period during which the strip is at an elevated temperature at which tempering occurs can be controlled by controlling the speed of the strip. That time period is also affected by the distance, downstream of bath 56, of air knives 26. The desired combination of conditions can be determined empirically by those skilled in the art.

The foregoing detailed description has been given for clearness of understanding only and no unnecessary limitations should be understood therefrom, as modifications will be obvious to those skilled in the art.

I claim:

1. A galvanized steel strip comprising a plain carbon steel substrate and an adherent, hot dip, metal coating consisting essentially of zinc or zinc alloy covering said substrate, said strip being characterized by:

a substrate composition consisting essentially of, in wt %:

| | |
|---|---|
| carbon | .03–.25 |
| manganese | .20–1.50 |
| phosphorous | .05 max. |
| sulfur | .03 max. |
| iron | essentially the balance; |

a substrate microstructure consisting essentially of tempered martensite comprising a martensitic matrix with iron carbide particles dispersed throughout;

a tensile strength substantially greater than 120,000 psi (827 MPa);

and a coating weight substantially greater than about 30 $g/m^2$/side.

2. A strip as recited in claim 1 wherein:

said tensile strength is at least about 155,000 psi (1034 MPa).

3. A strip as recited in claims 1 or 2 wherein:

said coating weight is in the range of about 60–130 $g/m^2$/side.

4. A strip as recited in claim 1 wherein:

said substrate has a ratio of yield strength to tensile strength of at least about 0.95.

5. A strip as recited in claim 1 wherein:

there is essentially no detectable layer of iron-zinc alloy between said substrate and said coating.

6. A strip as recited in claim 1 wherein:

said strip is elongated and is in the form of a coil having a multitude of coil laps and a pair of strip ends;

and said substrate has substantially uniform mechanical properties between said strip ends.

7. A strip as recited in claim 1 wherein:

said substrate has a thickness in the range of about 0.02–0.07 in. (0.51–1.78 mm);

and there is relatively uniform microhardness across the thickness of said substrate, compared to an ungalvanized strip having the same composition and a microstructure of untempered martensite.

8. A strip as recited in claim 1 wherein:

said carbon content is at least about 0.09 wt. % and said manganese content is at least about 0.34 wt. %.

9. A strip as recited in claim 1 wherein:

said iron carbide particles have an average size in the range 2 to 3 microns ($2–3\times10^{-6}$m);

the average spacing between iron carbide particles is in the range of about 10 to 20 microns ($10–20\times10^{-6}$m);

and said iron carbide particles cover about 10 to 20% of the total visible area in a cross-sectional view of said microstructure.

10. A deformed, fabricated, galvanized steel product having at least one inside corner and a planar area thereon, said product comprising a plain carbon steel substrate and an adherent, hot dip, metal coating consisting essentially of zinc or zinc alloy covering said substrate at said inside corner and at said planar area, said product being characterized by:

a substrate composition consisting essentially of, in wt %:

| | |
|---|---|
| carbon | .03–.25 |
| manganese | .20–1.50 |
| phosphorous | .05 max. |
| sulfur | .03 max. |
| iron | essentially the balance; |

a substrate microstructure consisting essentially of tempered martensite comprising a martensitic matrix with iron carbide particles dispersed throughout;

a tensile strength substantially greater than 120,000 psi (827 MPa);

and a coating weight substantially greater than about 30 $g/m^2$/side;

there being no substantial difference between the coating weight at said inside corner and the coating weight at said planar area.

11. A product as recited in claim 10 wherein:

said tensile strength is at least about 155,000 psi (1034 MPa).

12. A product as recited in claims 10 or 11 wherein:

said coating weight is in the range of about 60–130 $g/m^2$/side.

13. A product as recited in claim 11 wherein:

said substrate has a ratio of yield strength to tensile strength of at least about 0.95.

14. A product as recited in claim 10 wherein:

there is essentially no detectable layer of iron-zinc alloy between said substrate and said coating.

15. A product as recited in claim 10 herein:

said substrate has a thickness in the range of about 0.02–0.07 in. (0.51–1.78 mm);

and there is relatively uniform microhardness across the thickness of said substrate, compared to an ungalvanized steel product having the same composition and a microstructure of untempered martensite.

16. A product as recited in claim 10 wherein:

said carbon content is at least about 0.09 wt. % and said manganese content is at least about 0.34 wt. %.

17. A product as recited in claim 10 wherein:

said iron carbide particles have an average size in the range 2 to 3 microns ($2–3\times10^{-6}$m);

the average spacing between iron carbide particles is in the range of about 10 to 20 microns ($10–20\times10^{-6}$m);

and said iron carbide particles cover about 10 to 20% of the total visible area in a cross-sectional view of said microstructure.

* * * * *